US005355660A

United States Patent [19]

Shimon

[11] Patent Number: 5,355,660

[45] Date of Patent: Oct. 18, 1994

[54] SADDLE RIGGING

[76] Inventor: Ralph S. Shimon, Rte. 2, Box 181, Torrington, Wyo. 82240

[21] Appl. No.: 145,766

[22] Filed: Oct. 29, 1993

[51] Int. Cl.[5] ..... B68C 1/14

[52] U.S. Cl. ..... 54/46.2

[58] Field of Search ..... 54/23, 46.1, 46.2

[56] References Cited

U.S. PATENT DOCUMENTS

| | | | |
|---|---|---|---|
| 186 | 4/1837 | Baldwin | 54/46.2 |
| 34,044 | 12/1861 | Eagle | 54/46.2 |
| 2,418,103 | 3/1947 | Wells | 54/46.2 |
| 3,289,389 | 12/1966 | Herrera | 54/23 |
| 3,348,362 | 10/1967 | Herrera | 54/23 |

FOREIGN PATENT DOCUMENTS

| | | | |
|---|---|---|---|
| 390704 | 10/1908 | France | 54/46.2 |

*Primary Examiner*—Robert P. Swiatek
*Attorney, Agent, or Firm*—Dean P. Edmundson

[57] ABSTRACT

An improved attachment ring having forward and rearward attachment positions. A latigo secured to the ring can be easily moved from one attachment position to the other position without detaching the latigo from the ring.

6 Claims, 2 Drawing Sheets

FIG. 1
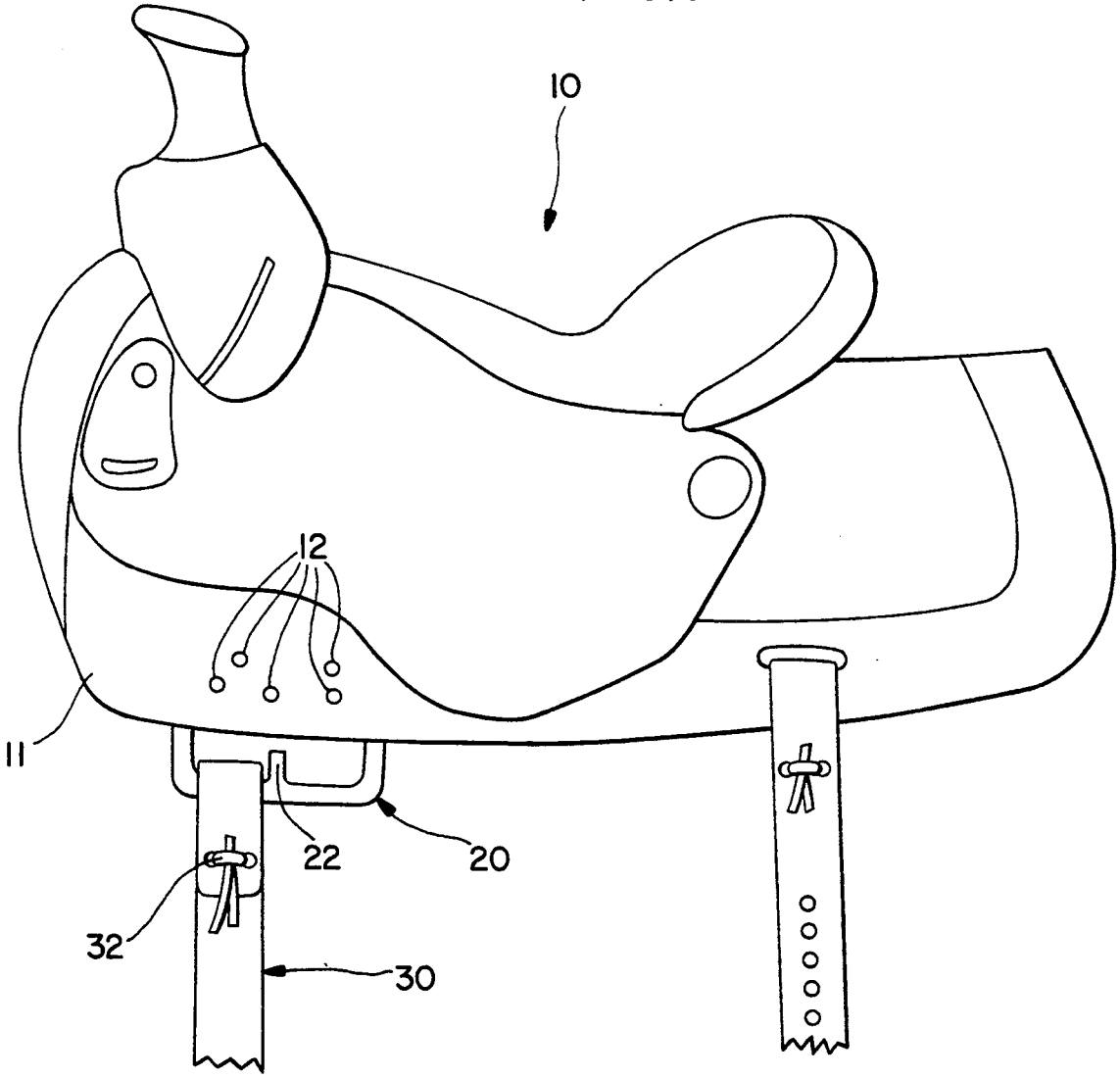
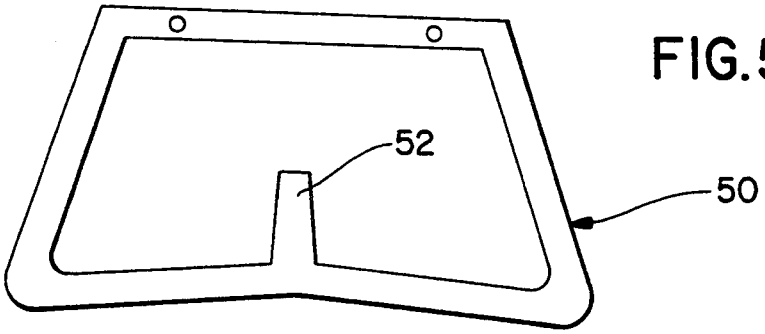
FIG. 5

SADDLE RIGGING

FIELD OF THE INVENTION

This invention relates to saddles of the type used on horses and mules. More particularly, this invention relates to devices and techniques for attaching a latigo to a saddle.

BACKGROUND OF THE INVENTION

A typical saddle for use on a horse or mule is secured to the animal by means of a cinch which extends around the girth of the animal and is attached to each of the opposite sides of the saddle by means of a latigo leather or nylon strap (hereafter referred to as the "latigo"). The saddle includes a D-ring secured on each side to which one end of the latigo leather or nylon strap is attached and firmly secured. Normally the latigo is secured to the D-ring by extending one end through the ring and looping it back upon itself. Then a length of leather lacing is threaded through several registering openings in the latigo. The leather lacing is then tied to prevent it from being pulled loose.

The free end of the latigo is passed through a ring on one end of the cinch and is looped back through the D-ring. Depending upon where the D-rings are located on the saddle, and depending upon the conformation of the particular horse or mule, the cinch and latigo are often positioned too far forwardly when the saddle is positioned on the withers of the animal. For example, the withers on some animals are not well defined or are located farther forward than on other animals. As a result, when the cinch is tightened to secure the saddle to the animal, the cinch and the latigo are so far forward that they can rub on the back of the shoulder of the animal or pinch skin between the cinch and the shoulder.

To overcome this problem, there has previously been proposed the use of a double D-ring on each side of a saddle. The double D-ring includes two alternative and separate attachment points from the latigo, with one attachment point being located forwardly of the other point. That is, one end of the latigo can be passed through and secured firmly to the forward position or instead it may be passed through and secured to the rearward position. This arrangement allows for a person to affix one end of the latigo to either the forward position or to the rearward position, as required in order to best fit the saddle to a particular horse.

Although it is possible to change the attachment of the latigo from the forward position to the rearward position, or vice-versa, this is very cumbersome and time-consuming. It requires that the leather lacing securing the latigo to the D-ring be untied and then completely unlaced from the latigo. Then the latigo must be entirely detached from one position on the D-ring and changed to the other position on the D-ring, after which the leather lacing must again be threaded through the registering openings in the latigo. After the lacing has been properly threaded again, it must be tied or otherwise secured. Because this task is so cumbersome and time-consuming, a person normally does not change the latigo attachment position at all after the latigo has been originally secured to one of the two positions on the D-ring. The result is that the saddle is used only on the horse or mule for which it was originally intended, or the saddle does not properly fit other horses or mules on which it may be used.

There has not heretofore been provided a means for attaching a latigo to a saddle which enables the attachment position to be easily changed without unfastening and detaching the latigo from the saddle.

SUMMARY OF THE INVENTION

In accordance with the present invention there is provided improved attachment means for securing one end of a latigo to a saddle which enables the latigo to be readily moved from one attachment position to another attachment position without detaching or loosening the latigo from the saddle. The novel attachment means comprises the use of an attachment ring which includes at least two attachment positions which are separated from each other by an upstanding finger. The finger is sufficient to prevent the latigo from shifting from one position to another when the cinch is tightened. Yet, the finger is sufficiently short that it enables the latigo to be easily raised and moved over the finger to another attachment position when the cinch is loosened.

Use of the attachment means of this invention enables the latigo to be readily and easily moved from one position to another position without detaching the latigo from the saddle. This attachment means is very advantageous as compared to the use of a conventional double D-ring and is much easier and convenient to use.

Other advantages of the attachment means of this invention will be apparent from the following detailed description and the accompanying drawings.

BRIEF DESCRIPTION OF THE DRAWINGS

The invention is described in more detail hereinafter with reference to the accompanying drawings wherein like reference characters refer to the same parts throughout the several views and in which:

FIG. 1 is a side elevational view of a saddle which includes an attachment ring in accordance with the present invention;

FIG. 5 is an elevational view of another embodiment of attachment ring of the invention.

DETAILED DESCRIPTION OF THE INVENTION

Figure 2:
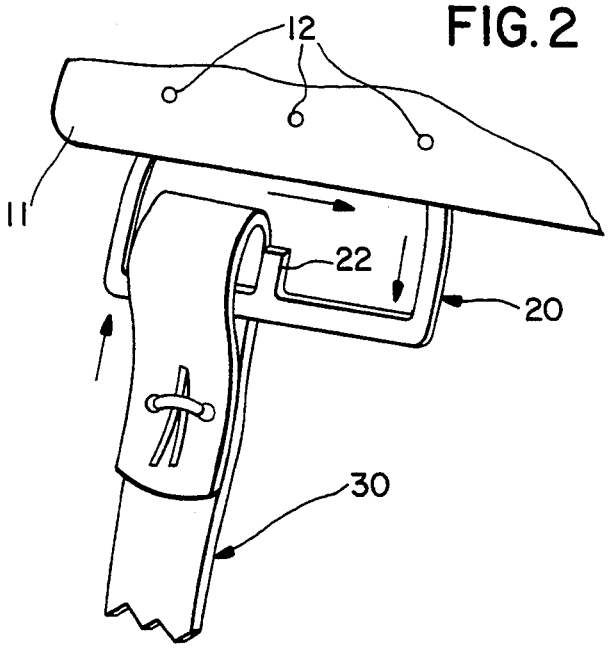
FIG. 2 is a perspective view illustrating the manner in which a latigo can be moved from one attachment position to another position on the ring.

In the drawings there is shown a saddle 10 which includes an attachment ring 20 of the invention secured to the saddle. One end of a conventional latigo strap 30 is looped through the attachment ring and secured to the strap by means of leather lacing 32 or the like. The other end of the latigo is intended to be looped through a ring 40 on one end of a conventional cinch 42 (shown in FIG. 4). In FIG. 1 the latigo is in the forward attachment position on the ring.

The attachment ring 20 is permanently secured to the saddle by means of several rivets 12, with the lower portion of the ring preferably extending below the lower edge of the skirt portion 11 of the saddle. As illustrated in the drawings, the ring includes two attachment positions for the looped end of the latigo. There is a forward attachment position and a rearward attachment position. These two attachment positions are separated by an upwardly extending post or prong 22 whose lower end is secured to, or integral with, the base portion of the ring. The upper end of the post 22 extends upwardly from the base of the ring about 0.5 to one inch or so.

It is essential that there be a gap between the upper end of the post 22 and the lower edge of the skirt portion 11 of the saddle. This gap enables the looped end of the latigo to be moved between the forward and rearward attachment positions on the ring. This ease of movement of the latigo is illustrated in FIG. 2. Thus, in order to move the looped end of the latigo 30 from the forward position to the rearward position the looped end of the latigo is first moved upwardly relative to the attachment ring, then it is moved rearwardly over the upper end of the post 22 to the rearward portion of the ring, and then the latigo is moved downwardly into the rearward position. The arrows in FIG. 2 illustrate this simple action to change the latigo attachment position without having to unlace or detach the latigo from the attachment ring.

Figure 3:
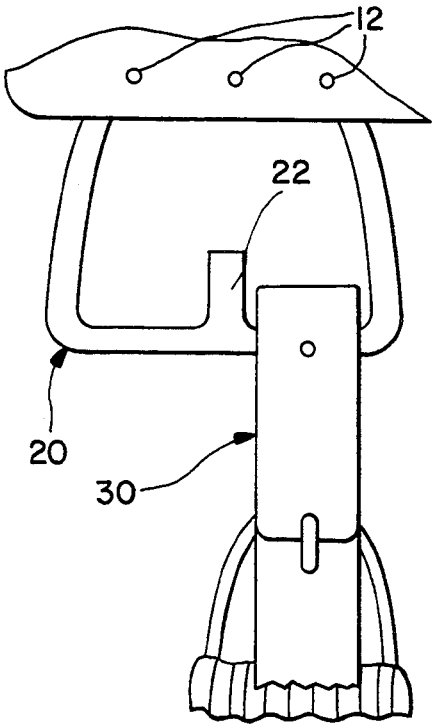
FIG. 3 is a side elevational view showing the latigo attached to the attachment ring in the rearward position.

FIG. 3 is an elevational view showing the looped end of the latigo in the rearward attachment position on the attachment ring 20. This rearward position for the latigo is commonly referred to as a $\frac{3}{4}$ rigging position and is useful or required when securing a saddle to certain horses and mules in order to prevent the cinch and latigo from rubbing against or interfering with the shoulder of the horse or mule.

Figure 4:
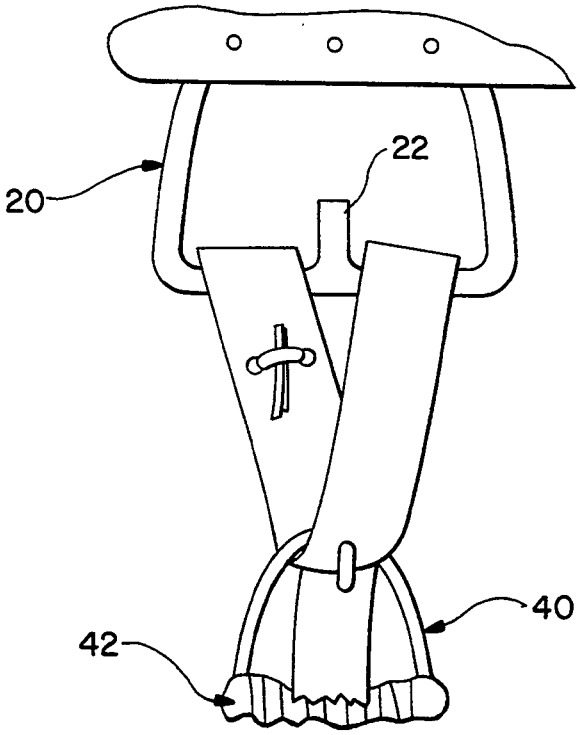
FIG. 4 is a side elevational view showing the latigo attached to the attachment ring in another manner.

FIG. 4 shows yet another manner in which the attachment ring can be used. In this arrangement the looped end of the latigo is in the forward ring position and the latigo is then passed through the cinch ring 40 and then through the rearward position in ring 20. This is commonly referred to as a $\frac{7}{8}$ rigging position. This arrangement is useful when it is necessary or desirable to have the latigo and cinch positioned slightly rearwardly from the full double rigging position.

FIG. 5 is a side elevational view of another embodiment of attachment ring 50 of the invention. In this embodiment the base of the ring is not flat. Rather, the base slopes upwardly from each end toward the center where the post 52 extends upwardly from the base a sufficient distance to prevent the looped end of the latigo from shifting forwardly or rearwardly. However, the end of the latigo can be raised upwardly above the upper end of the post and then moved easily from one attachment position to another attachment position.

Thus, the attachment ring of this invention enables the looped end of the latigo to be easily moved from one attachment position to another position without unlacing the latigo or detaching it from the ring. Although only one side of the saddle is shown in the drawings, a similar attachment ring as shown in the drawings is also used on the opposite side of the saddle. A separate latigo is used on the opposite side to attach the opposite end of the cinch to the attachment ring.

Other variants are possible without departing from the scope of the invention. For example, more than two attachment positions could be provided in the ring, if desired. When there are two attachment positions on the ring, it is preferred for the post member to be located at the center of the base of the ring, as shown. The width of the base of the ring is normally at least about 4 inches.

What is claimed is:

1. In a saddle intended to be secured to the back of an animal by means of a cinch extending around the girth of said animal, wherein the cinch is attached to said saddle by means of a latigo; wherein said saddle includes a skirt member having a forward portion; wherein the improvement comprises at least one attachment ring secured in said forward portion of said skirt member of said saddle such that said at least one ring does not move or freely swing relative to said skirt member, wherein said ring comprises forward and rearward attachment positions and an upwardly projecting post member separating said forward and rearward positions; and wherein said latigo is attached to said at least one ring and can be moved over said post member between said forward and rearward positions without detaching said latigo from said at least one ring.

2. The improvement in accordance with claim 1, wherein said saddle has left and right sides, and wherein there is one attachment ring secured to each said side of said saddle.

3. The improvement in accordance with claim 1, wherein said at least one attachment ring comprises a base portion, and wherein said post member extends upwardly from said base portion.

4. The improvement in accordance with claim 3, wherein said post member extends upwardly at least about 0.5 inch above said base portion.

5. The improvement in accordance with claim 4, wherein said post member is positioned in the center of said base portion.

6. In a saddle intended to be secured to the back of an animal by means of a cinch extending around the girth of said animal, wherein the cinch is attached to said saddle by means of a latigo, wherein said saddle includes a skirt member having a forward portion; wherein the improvement comprises an attachment ring secured in said forward portion of said skirt member on each side of the saddle such that said ring does not move or freely swing relative to said skirt member, wherein each said ring comprises forward and rearward attachment positions; wherein said attachment ring comprises an upwardly projecting post member separating said forward and rearward positions; wherein said latigo is attached to said ring and can be moved between said forward and rearward positions by moving said latigo over said post member without detachment from said ring.

* * * * *